US011834134B2

(12) United States Patent
Livingston

(10) Patent No.: US 11,834,134 B2
(45) Date of Patent: Dec. 5, 2023

(54) SYSTEMS FOR LIFTING AND STOWING WATER-BORNE VESSELS

(71) Applicant: John Livingston, Seattle, WA (US)

(72) Inventor: John Livingston, Seattle, WA (US)

( * ) Notice: Subject to any disclaimer, the term of this patent is extended or adjusted under 35 U.S.C. 154(b) by 0 days.

(21) Appl. No.: 17/365,211

(22) Filed: Jul. 1, 2021

(65) Prior Publication Data

US 2021/0323641 A1 Oct. 21, 2021

Related U.S. Application Data

(63) Continuation of application No. 16/788,982, filed on Feb. 12, 2020, now Pat. No. 11,052,975.

(51) Int. Cl.
*B63B 23/32* (2006.01)
*B63B 23/08* (2006.01)

(52) U.S. Cl.
CPC ..... *B63B 23/32* (2013.01); *B63B 23/08* (2013.01)

(58) Field of Classification Search
CPC ..... B63B 23/32; B63B 23/08
See application file for complete search history.

(56) References Cited

U.S. PATENT DOCUMENTS 3,401,806 A * 9/1968 Schmit ..... B63C 3/06 414/678
3,418,671 A * 12/1968 Marotta ..... B63B 23/06 414/678
3,647,089 A * 3/1972 Christensen ..... B63B 23/06 114/263
5,133,275 A * 7/1992 Maurizio ..... B63B 23/32 114/259
5,193,479 A * 3/1993 Bielefeld ..... B63B 23/32 114/259
6,038,994 A * 3/2000 Ford ..... B63B 23/32 114/259
8,631,752 B2 * 1/2014 Hauersperger ..... B63B 23/06 114/259
9,308,971 B2 * 4/2016 Isbill ..... B63B 23/32

* cited by examiner

*Primary Examiner* — S. Joseph Morano
*Assistant Examiner* — Jovon E Hayes
(74) *Attorney, Agent, or Firm* — Fox Rothschild LLP

(57) ABSTRACT

Systems and methods are provided for lifting and stowing water-borne vessels. The systems and methods can be used, for example, to lift a small vessel, such an inflatable dinghy, onto a larger water-borne vessel equipped with an outboard motor; and to stow the dinghy above the outboard motor. The systems and methods permit the dinghy to be lifted out of the water from a position behind the larger vessel, with any need to remove, disassemble, or move the outboard motor.

6 Claims, 5 Drawing Sheets

SYSTEMS FOR LIFTING AND STOWING WATER-BORNE VESSELS

CROSS REFERENCE TO RELATED APPLICATION

This application is a continuation of U.S. application Ser. No. 16/788,982, filed Feb. 12, 2020, the contents of which is incorporated herein by reference in its entirety.

FIELD

The disclosed technology relates generally to systems and methods for lifting water-borne vessels out of the water and onto larger vessels or structures, and stowing the smaller vessels on the larger vessels or structures.

BACKGROUND

Medium and large-size boats used for recreational purposes often carry a smaller water-borne vessel, commonly referred to as a tender. For example, many boats carry a tender in the form of an inflatable, motorized dinghy that can be used, for example, to provide shore access in situations where a suitable docking facility is not available, or to transfer passengers to another boat while on the open water. The dinghy is stowed on the boat, deployed into the water when needed, and hoisted back onto the boat after use. Because most dinghies are relatively heavy, some type of mechanical apparatus, such as davits or a winch-actuated sling or cable system, often is used to deploy and retrieve the dinghy.

Typically, the stern of the boat is the most convenient location boat from which the deploy and retrieve a dinghy. For example, many recreational boats have a swim platform on the stern that allows passengers to move easily between the boat and the water. The swim platform can provide ready access to a dinghy positioned next to the stern, and if large enough, can act as a storage location for the dinghy. Deploying and retrieving a dinghy or other small craft from the stern of the boat, however, can be difficult or impracticable when the boat is equipped with an outboard motor, which typically is mounted at the midpoint of the stern and thus obstructs access to a large part of the stern. Also, an outboard motor can make it impracticable to store the dinghy on the swim platform.

Once on board the boat, the dinghy must be securely stowed within the confines of the boat. In boats without a cabin, the dinghy may need to be stowed in the cockpit or other areas of the boat normally occupied by passengers, thereby reducing the available passenger space. In boats equipped with a cabin, the cabin roof can be a suitable storage location if sufficient free space is available on the roof. Moving a relatively large and heavy item such as a dinghy onto the cabin roof, however, can be difficult and can present a safety hazard, especially when the boat is operating in a rough sea state. Also, the need to retrieve the dinghy from the cabin roof can delay the deployment of the dinghy in time critical situations such as rescue operations or evacuation of the boat under emergency conditions.

SUMMARY

The present disclosure relates generally to systems for lifting water-borne vessels out of the water and onto larger vessels or structures, and stowing the smaller vessels on the larger vessels or structures. In one aspect, the disclosed technology relates to systems for lifting and stowing a water-borne vessel. The systems include a first and a second mounting bracket configured to be secured to a substantially horizontal mounting surface; and a lifting frame having a first and a second side and configured to rotate in relation to the first and second mounting brackets between a first and a second angular position.

The first side of the lifting bracket includes a first side member coupled to and rotatable in relation to first mounting bracket; a third side member connected to the first side member; and a fifth side member connected to the first and third side members and configured to provide a supporting surface for the water-borne vessel. The second side of the lifting bracket includes a second side member coupled to and rotatable in relation to the second mounting bracket; a fourth side member connected to the second side member; and a sixth side member connected to the second and fourth side members and configured to provide another supporting surface for the water-borne vessel. The fifth and sixth side members each have a substantially horizontal orientation when the lifting frame is in the second angular position. The first and second mounting brackets are configured to restrain the respective first and second side members from rotating in a direction away from the first angular position when the lifting frame is in the second angular position.

In another aspect of the disclosed technology, the lifting frame further includes a first cross member and a second cross member each connected to the first and second sides of the lifting frame.

In another aspect of the disclosed technology, the first cross member is connected to the third side member and the fourth side member; and the second cross member is connected to the fifth side member and the sixth side member.

In another aspect of the disclosed technology, the fifth side member and the sixth side member are disposed at an acute angle in relation to the horizontal direction when the lifting frame is in the first angular position.

In another aspect of the disclosed technology, the second cross member is configured to be connected to the water-borne vessel.

In another aspect of the disclosed technology, the second cross member is configured to be connected to a first side of the water-borne vessel so that the water-borne vessel can rotate about the second cross member and onto the lifting frame.

In another aspect of the disclosed technology, the system further incudes a winch configured to be connected to a second side of the water-borne vessel.

In another aspect of the disclosed technology, the winch is connected to the second side of the water-borne vessel by a rope or a cable routed over the first cross member and configured to exert a force on the second side of the water borne vessel when the rope or cable is tensioned by the winch.

In another aspect of the disclosed technology, the force causes the water-borne vessel to rotate onto the lifting platform when the lifting platform is in the second position of the lifting platform.

In another aspect of the disclosed technology, the force further causes the lifting frame to rotate from the first to the second angular position after the water-borne vessel rotates onto the lifting platform.

In another aspect of the disclosed technology, the first angular position is offset from the second angular position by about 45 degrees.

In another aspect of the disclosed technology, the substantially horizontal mounting surface is a surface of a boat;

and the lifting frame is further configured so that the first and second sides of the lifting frame straddle an outboard motor mounted on a stern of the boat when the lifting frame is in the first angular position.

In another aspect of the disclosed technology, the lifting frame is further configured so that the first cross member is positioned above the outboard motor when the lifting frame is in the first angular position.

In another aspect of the disclosed technology, the lifting frame is further configured so that the second cross member rotates up and over the outboard motor when the lifting frame rotates from the first angular position to the second angular position.

In another aspect of the disclosed technology, the first and second sides of the lifting frame each has a substantially triangular configuration.

In another aspect of the disclosed technology, a first end of the first side member is coupled to the first mounting bracket; a first end of the third side member is connected to the first side member proximate the first end of the first side member; a second end of the third side member is connected to a first end of the fifth side member; and a second end of the first side member is connected to the fifth side member proximate a second end of the fifth side member.

In another aspect of the disclosed technology, the fifth side member extends diagonally between the first side member and the third side member and is oriented at angle of about 45 degrees in relation to the horizontal when the lifting platform is in the lowered position; and a top surface of each of the mounting brackets is oriented at angle of about 45 degrees in relation to the horizontal.

In another aspect of the disclosed technology, a portion of the fifth side member proximate the second end of the fifth side member is curved, so that the second end of the fifth side member has a substantially vertical orientation when the lifting frame is in the lowered position.

In another aspect of the disclosed technology, the lifting frame further includes a step mounted on the second side member.

In another aspect of the disclosed technology, methods for lifting a water-borne vessel onto a boat having an outboard motor include connecting a first side of the water-borne vessel to a cross member of a lifting frame mounted on the boat; applying a force to a second side of the water-borne vessel to flip the water-borne vessel onto lifting frame; and applying additional force to the second side of the water-borne vessel to move the lifting frame so as to position the water-borne vessel over the outboard motor.

In another aspect of the disclosed technology, applying a force to a second side of the water-borne vessel to flip the water-borne vessel onto the lifting frame comprises applying the force to flip the water-borne vessel onto two side members of the lifting frame when the side members are disposed at an acute angle in relation to the horizontal direction; and applying additional force to the second side of the water-borne vessel to move the lifting frame so as to position the water-borne vessel over the outboard motor comprises applying the additional force to move the lifting frame so that the side members assume a substantially horizontal orientation in relation to the horizontal direction.

In another aspect of the disclosed technology, systems are provided for lifting and stowing a first water-borne vessel on a second water-borne vessel, wherein the second water-borne vessel has an outboard motor mounted on a stern of the second water-borne vessel. The systems include a first and a second mounting bracket configured to be secured to a mounting surface on the second water-borne vessel; and a lifting frame coupled to and configured to rotate in relation to the first and second mounting brackets between a first and a second angular position.

The lifting frame is configured so that the first and second sides of the lifting frame are located on opposite sides of the outboard motor when the lifting frame is in the first angular position. The lifting frame is further configured to support the first water-borne vessel above the outboard motor when the lifting frame is in the second angular position.

In another aspect of the disclosed technology, the lifting frame further includes a first cross member and a second cross member each connected to the first and second sides of the lifting frame.

In another aspect of the disclosed technology, the second cross member is configured to be connected to the first water-borne vessel.

In another aspect of the disclosed technology, the second cross member is configured to be connected to a first side of the first water-borne vessel so that the first water-borne vessel can rotate about the second cross member and onto the lifting frame.

In another aspect of the disclosed technology, the systems further include a winch configured to be mounted on the second water-borne vessel and connected to a second side of the first water-borne vessel by a rope or a cable configured to exert a force on the second side of the first water-borne vessel when the rope or cable is tensioned by the winch.

In another aspect of the disclosed technology, the force causes the first water-borne vessel to rotate onto the lifting platform when the lifting platform is in the second position of the lifting platform.

In another aspect of the disclosed technology, the force further causes the lifting frame to rotate from the first to the second angular position after the first water-borne vessel rotates onto the lifting platform.

In another aspect of the disclosed technology, the first side of the lifting bracket includes a first side member coupled to and rotatable in relation to first mounting bracket;

a third side member connected to the first side member; and a fifth side member connected to the first and third side members and configured to provide a supporting surface for the first water-borne vessel.

The second side of the lifting bracket includes a second side member coupled to and rotatable in relation to the second mounting bracket; a fourth side member connected to the second side member; and a sixth side member connected to the second and fourth side members and configured to provide another supporting surface for the first water-borne vessel.

In another aspect of the disclosed technology, the fifth and the sixth side members each have a substantially horizontal orientation when the lifting frame is in the second angular position.

In another aspect of the disclosed technology, the first and second mounting brackets are configured to restrain the respective first and second side members from rotating in a direction away from the first angular position when the lifting frame is in the second angular position.

BRIEF DESCRIPTION OF THE DRAWINGS

The accompanying drawings, which are incorporated herein and constitute part of this specification, are illustrative of particular embodiments of the present disclosure and do not limit the scope of the present disclosure. The drawings are not to scale and are intended for use in conjunction with the explanations in the following detailed description.

DETAILED DESCRIPTION

Figure 1:
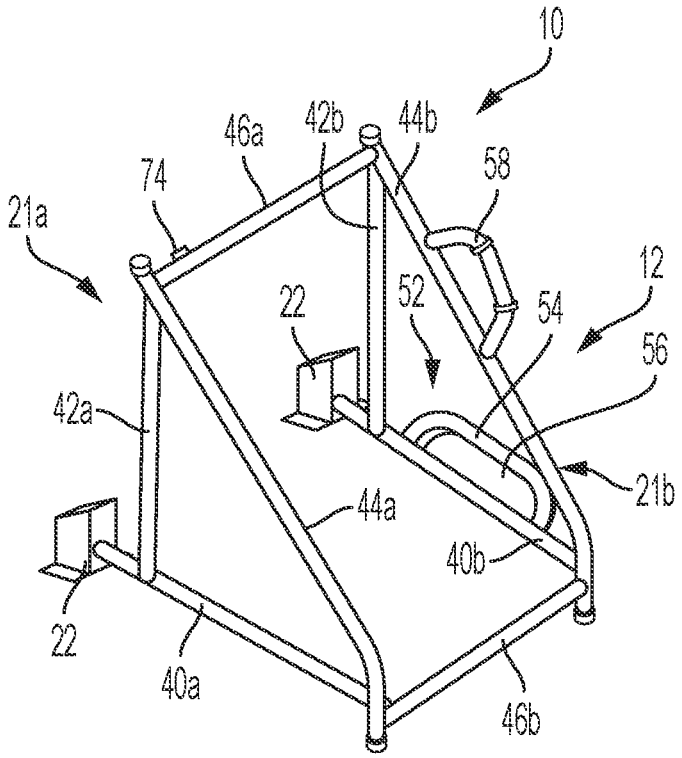
FIG. 1 is a top-side perspective view of a system for lifting and stowing water-borne vessels, showing a lifting frame of the system in a lowered position.

The following discussion omits or only briefly describes conventional features of the disclosed technology that are apparent to those skilled in the art. It is noted that various embodiments are described in detail with reference to the drawings, in which like reference numerals represent like parts and assemblies throughout the several views. Reference to various embodiments does not limit the scope of the claims appended hereto. Additionally, any examples set forth in this specification are intended to be non-limiting and merely set forth some of the many possible embodiments for the appended claims. Further, particular features described herein can be used in combination with other described features in each of the various possible combinations and permutations.

The figures disclose a system 10 for lifting and stowing water-borne vessels. The system 10 can be used, for example, to lift an inflatable dinghy 12 onto a larger water-borne vessel such as a medium-size boat 14, and to stow the dinghy 12 above an outboard motor 16 of the boat 14. The system 10 permits the dinghy 12 to be lifted out of the water from a position behind the boat 14, with any need to remove, disassemble, or move the outboard motor 16. This particular application of the system 10 is disclosed for illustrative purposes only. The system 10, and variants thereof, can be used to lift and stow other types of water-borne vessels, such as skiffs, rafts, personal watercraft, etc. Also, the system 10, and variants thereof, can be installed on water-borne vessels other than the boat 14, and on shore structures such as boat docks.

Figure 8:
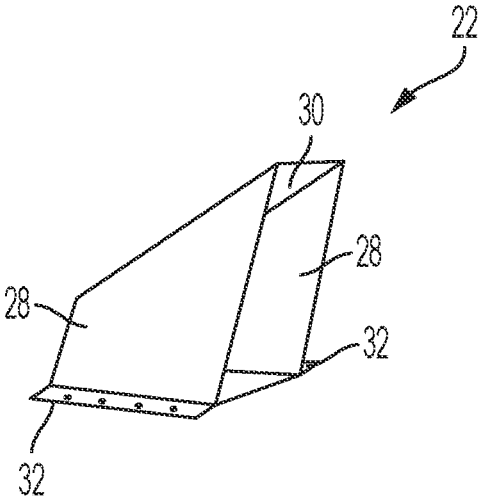
FIG. 8 is a rear perspective view of a mounting bracket of the system shown in FIGS. 1-6.

Referring to FIGS. 1-5, the system 10 includes a lifting frame 20, and two mounting brackets 22. The mounting brackets 22 couple the lifting frame 20 to the boat 14. The mounting bracket 22 facilitate rotation of the lifting frame 20 between a lowered, or first angular position shown in FIGS. 1-3 and 5; and a stowed, or second angular position shown in FIGS. 4 and 6. The mounting brackets 22 can be securely mounted on an upper surface 23 of a swim platform 24 of the boat 14 as shown in FIGS. 1-3 and 5, using fasteners or other suitable means. Each mounting bracket 22 includes two side portions 28, and a top portion 30 that adjoins each of the side portions 28, as can be seen in FIG. 8. The top portion 30 is oriented at an angle of about 45 degrees in relation to the upper surface 23 of the swim platform 24. The top portion 30 can have other orientations in alternative embodiments. Each mounting bracket 22 also includes two flanges 32. Each flange 32 adjoins a bottom edge of a corresponding side portion 28, and has through holes for receiving the fasteners that secure the mounting bracket 22 to the swim platform 24.

Referring to FIGS. 1-4, the lifting frame 20 includes a first side member 40*a*; and a substantially identical second side member 40*b*. The lifting frame 20 also includes a third side member 42*a*; and substantially identical fourth side member 42*b*. The lifting frame 20 further includes fifth side member 44*a*; and a substantially identical sixth side member 44*b*. The lifting frame 20 also includes a first cross member 46*a*; and a second cross member 46*b*.

The above components can be formed from a rigid, durable, and weather-resistant material such as stainless steel. Other types of materials, such as aluminum, can be used in the alternative. Each of the components is formed as a tube having a circular cross-section. Other configurations, such as a solid rod, or a tube having a square or rectangular cross-section, can be used in the alternative.

Figure 2:
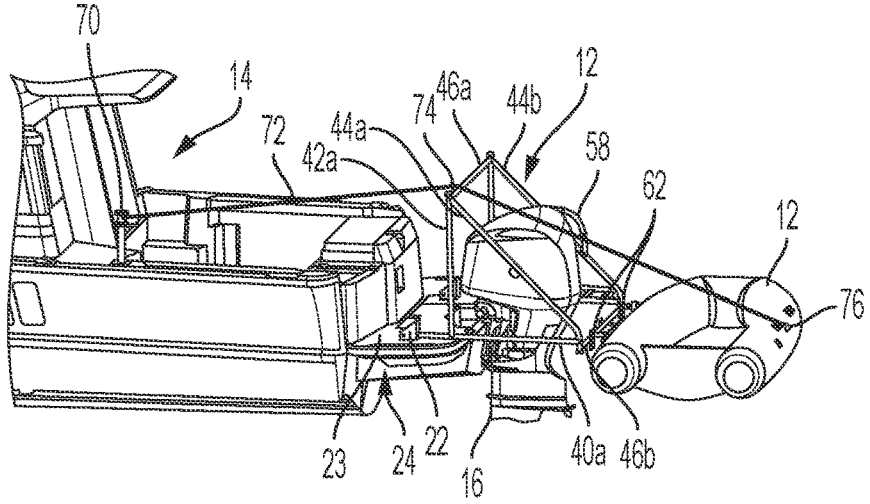
FIG. 2 is a rear-side perspective view of the system shown in FIG. 1, installed on a boat and attached to a dinghy, showing the lifting frame in the lowered position.

The first side member 40*a*; the third side member 42*a*; and the fifth side member 44*a* are connected in the below-described manner, and form a first side 21*a* of the lifting frame 20. The second side member 40*b*; the fourth side member 42*b*; and the sixth side member 44*b* are connected in same manner as the first side member 40*a*, the third side member 42*a*, and the fifth side member 44*a*; and form a second side 21*b* of the lifting frame 20. As shown in FIG. 2, the lifting frame 20 is configured so that the first and second sides 21*a*, 21*b* straddle, i.e., are located on opposite sides of, the outboard motor 16 when the lifting frame 20 is in the lowered position.

A first end of the first side member 40*a* is coupled to a first of the mounting brackets 22 by a pin, so that the first side member 40*a* can rotate in relation to the mounting bracket 22. A first end of the third side member 42*a* is securely connected to the first side member 40*a*, proximate the first end of the first side member 40*a*. The connection between the first side member 40*a* and the third side member 42*a*, and the connections between the various other components of the lifting frame 20, can be welds. Other types of connections, such as brackets and fasteners, can be used in the alternative.

A second end of the third side member 42*a* is connected to a first end of the fifth side member 44*a*. A second end of the first side member 40*a* is connected to the fifth side member 44*a* proximate a second end of the fifth side member 44*a*. As a result of this arrangement, the fifth side member 44*a* extends diagonally between the first and third side members 40*a*, 42*a*; and is oriented at angle of about 45 degrees in relation to the horizontal when the lifting frame 20 is in the lowered position. The lifting frame 20 can be configured so that the fifth side member 44*a* is oriented at angles other than 45 degrees in relation to the horizontal, in alternative embodiments.

The first side 21*a* of the lifting frame 20 thus has a substantially triangular configuration, with a portion of the first side member 40*a* extending from the base of the triangle to engage the corresponding mounting bracket 22, as can be seen in FIGS. 1-5. Also, as shown in FIGS. 1 and 2, a portion of the fifth side member 44*a* proximate the second end of the fifth side member 44*a* is curved, so that the second end of the fifth side member 44*a* has a substantially vertical orientation when the lifting frame 20 is in its lowered position.

The second side member 40*b*, fourth side member 42*b*, and sixth side member 44*b* are arranged in a substantially identical manner to the first side member 40*a*, third side member 42*a*, and fifth side member 44*a*, to form the second side 21*b* of the lifting frame 20.

Figure 4:
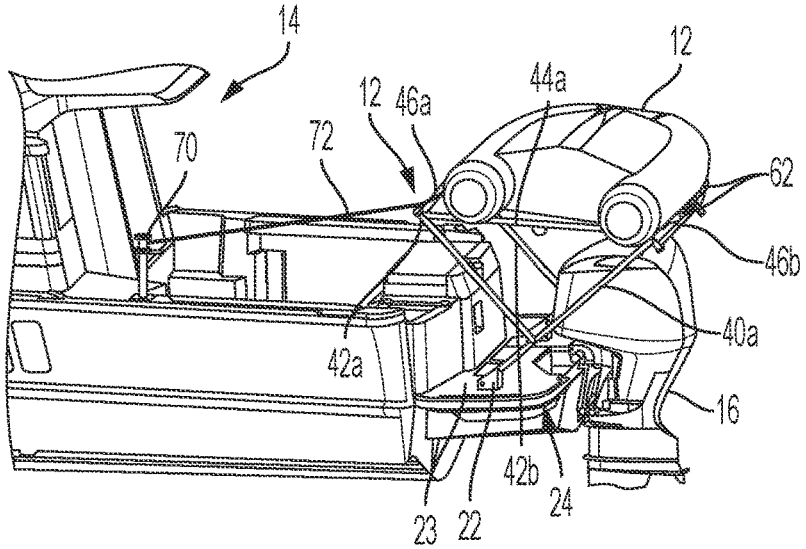
FIG. 4 is a rear-side perspective view of the system shown in FIGS. 1-3, installed on the boat and attached to the dinghy, showing the lifting frame in a stowed position after the dinghy has been lifted onto the boat and stowed on top of the lifting frame.
Figure 6:
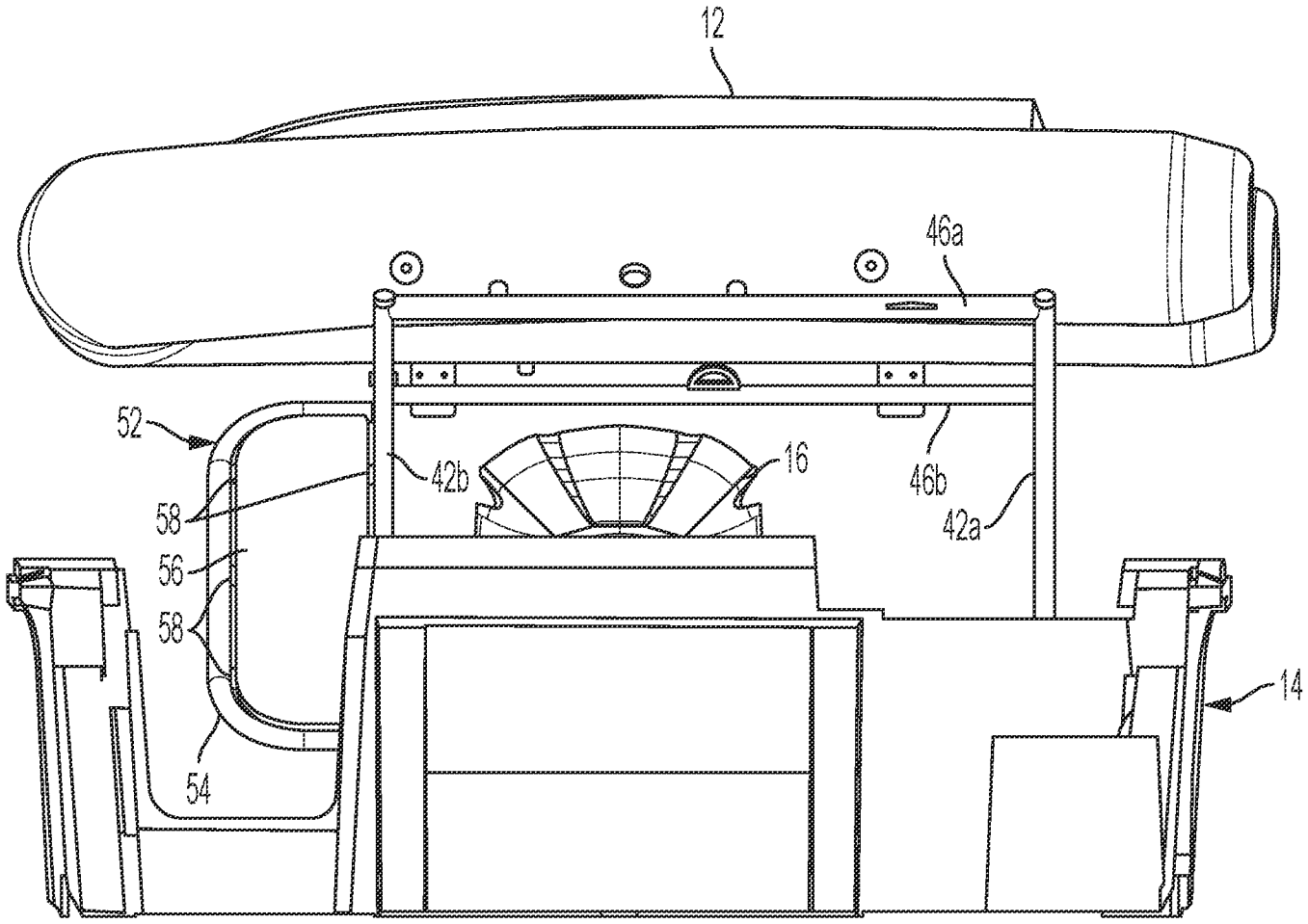
FIG. 6 is a front view of the system shown in FIGS. 1-5, installed on the boat and attached to the dinghy, showing the lifting frame in the stowed position after the dinghy has been lifted onto the boat and stowed on top of the lifting frame.
Figure 7:
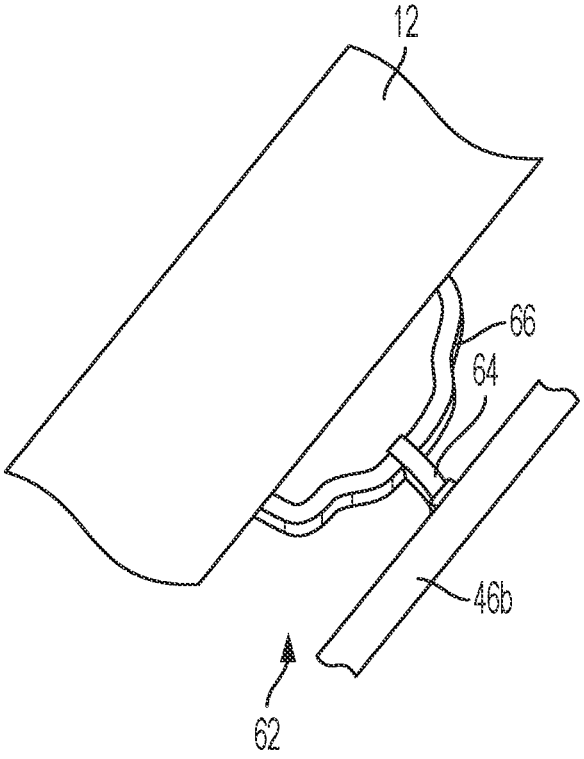
FIG. 7 is a top perspective view of a snap davit of the system shown in FIGS. 1-6, with a davit head of the davit connected to a hook of the davit.

The first and second sides 21*a*, 21*b* of the lifting frame 20 are connected by way of the first and second cross members 46*a*, 46*b*. A first end of the first cross member 46*a* is connected to the second end of the third side member 42*a*; and a second end of the first cross member 46*a* is connected to a second end of the fourth side member 42*b*. A first end of the second cross member 46*b* is connected to the second end of the fifth side member 44*a*; and a second end of the second cross member 46*b* is connected to a second end of the sixth side member 44*b*. As can be seen in FIG. 2, the first cross member 46*a* is positioned above the outboard motor 16, and the second cross member 46*b* is positioned behind the outboard motor 16 and proximate the water when the lifting frame 20 is in its lowered position. When the lifting frame 20 is in the stowed position, the first and second cross members 46*a*, 46*b* have a substantially horizontal orientation, and are located at nearly the same height, or vertical position, as shown in FIGS. 4 and 6.

Figure 5:
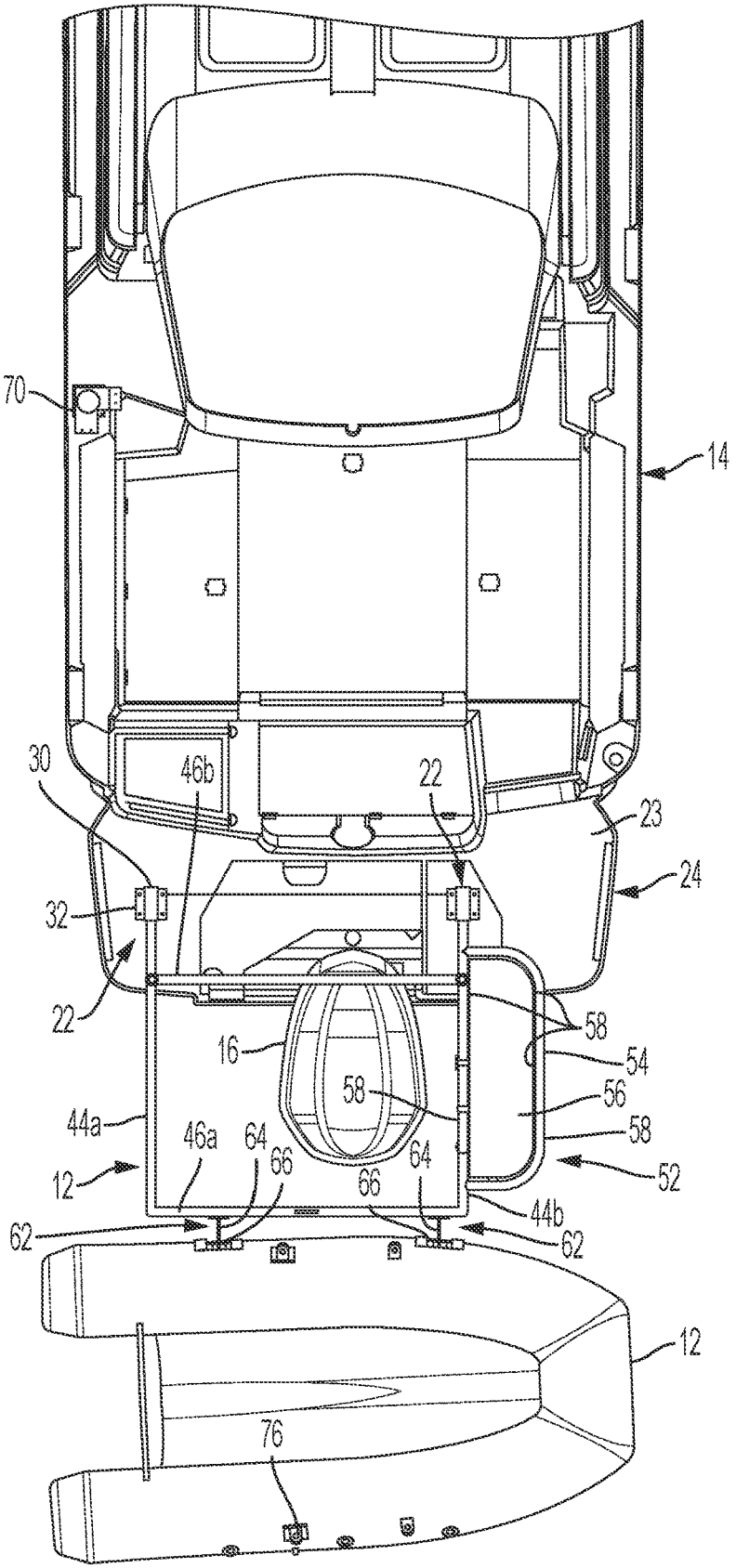
FIG. 5 is a top view of the system shown in FIGS. 1-4, installed on the boat and attached to the dinghy, showing the lifting frame in the lowered position.

The system 10 also includes a step 52 located on the lifting frame 20, as shown in FIG. 5. The step 52 provides access to and from the dinghy 12 when the lifting frame 20 is in its lowered position, and the dinghy 12 is in the water and connected to the lifting frame 20. The step 52 includes a substantially D-shaped frame member 54, and a platform 56. The ends of the frame member 54 are connected to the second side member 40*b*, proximate the respective first and second ends of the second side member 40*b*. The platform 56 is formed from high-strength plastic; the platform 56 can be formed for other materials, such as wood or canvas, in the alternative. The platform 56 is attached to, and is supported by cross members 58, partially visible in FIGS. 5 and 6. The cross members 58 are secured to the frame member 54 and the first side member 40*b*.

The system 10 also includes a curved handle 58 secured to the fifth side member 44*b*. The handle 58 can be grasped by the user for stability or other assistance as the user enters and exits the dinghy 12.

As can be seen in FIG. 5, an end of the platform 52 overlays the swim platform 24, and the remainder of the platform 52 spans a portion the space between the swim platform 24 and the dinghy 12. Also, the mounting brackets 22 are positioned so that the lifting frame 20 is offset toward the port side of the boat 14, as can be seen in FIGS. 5 and 6. This arrangement maintains access to the portion of the swim platform 24 proximate the starboard side of the boat 14. Thus, a user can easily and safely board the dinghy 12 by stepping across the swim platform 24 and the platform 56 of the step 52, while grasping the handle 58. The user likewise can exit the dinghy 12 and board the boat 14 by stepping across the platform 56 of the step 52 and onto the swim platform 24 while grasping the handle 58. Alternative embodiments of the system 10 can be configured without the handle 58 or the step 52; in other alternative embodiments, the handle 58 and the step 52 can be mounted on the first side 21*a* of the lifting frame 20, instead of the second side 21*b*.

Offsetting the lifting frame 20 from the center of the stern of the boat 14 can facilitate the installation and use of a boom crane (not shown) on the starboard side of the swim platform 24. The boom crane can be used to remove a motor from the dinghy 12, and to place the motor on a storage mount located on the transom of the boat 14.

Figure 3:
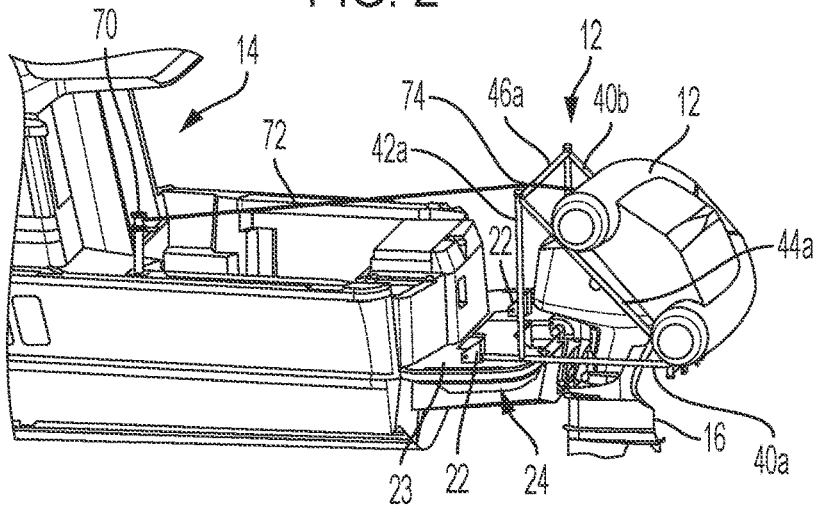
FIG. 3 is a rear-side perspective view of the system shown in FIGS. 1 and 2, installed on the boat and attached to the dinghy, showing the lifting frame in the lowered position as the dinghy is being lifted onto the boat.

The dinghy 12 can be connected to the lifting frame 20 in a manner that permits the dinghy 12 to rotate on its side, i.e., about its lengthwise axis, in relation to the lifting frame 20. For example, the system 10 can include snap davits 62, visible in FIGS. 2, 3, 5, and 7. Each snap davit 62 incudes a davit head 64 securely mounted on the second cross member 46*b*; and a hook 66 secured to a side of the dinghy 12. The davit head 64 and the hook 66 are configured so that the hook 66 can snap into its corresponding davit head 64. Once engaged, the hook 66 can rotate or pivot in relation to the davit head 64 while being retained by the davit head 64. This arrangement permits the dinghy 12 to rotate over and onto the lifting platform 20 as depicted in FIG. 3. Suitable snap davits are commercially available, for example, from Weaver Marine Products. Other means can be used to connect the dinghy 12 to the lifting frame 20. For example, rope, cables, bungees, latches, etc., can be used in lieu of the snap davits 62.

The system 10 also includes a winch 70 for hoisting the dinghy 12 and moving the lifting frame 20 to its stowed position. The winch 70 can be mounted on the port-side gunwale of the boat 14, as shown in FIGS. 2-5. The winch 70 can be mounted at other locations on the boat 14. The winch 70 is a hand winch. A motorized winch can be used in the alternative. As depicted in FIGS. 2 and 3, the winch 70 is mounted so that the height, or vertical position, of the winch 70 is less than the height of the first cross member 46*a* when the lifting frame 20 is in its lowered position, as can be seen in FIGS. 2-4. In the alternative, the winch 70 can be mounted so that its height is greater than, or about the same as the height of the first cross member 46*a* when the lifting frame 20 is in its lowered position The dinghy 12 can be connected to the winch 70 by a rope 72 or other suitable means such as a cable. The rope 72 can be routed through a guide 74 mounted on the first cross member 46*a* of the lifting frame 20. An end of the rope 72 can be fastened to a rope attachment anchor 76 located on the starboard side of the dinghy 12, as depicted in FIG. 1.

The dinghy 12 can be lifted and stowed as follows. The dinghy 12 is connected to the lifting frame 20 when the lifting frame 20 is in its lowered position. The dinghy 12 is maneuvered by the user to bring the port side of the dinghy 12 into proximity with the second cross member 46*b* of the lifting frame 20. The user then connects the hook 66 of each snap davit 62 to the corresponding davit head 64 on the second cross member 46*b*, as shown in FIG. 2. The user then attaches the rope 72 to the rope attachment anchor 76 on the starboard side of the dinghy 12.

The dinghy 12 is described as docking with the boat 14 by way of the port side of the dinghy 12 for illustrative purposes only. The dinghy 12 also can be configured to dock with the boat 14 by way of the starboard side of the dinghy 12.

Once the lifting frame 20 and the rope 72 have been connected to the dinghy 12, the winch 70 is actuated to draw in and tension the rope 72. Because the rope 72 is connected to the starboard side of the dinghy 12, the tensioned rope 72 initially exerts a force on the starboard side in the upward and forward directions. This force lifts the starboard side of the dinghy 12; and causes the dinghy 12 to rotate about its point of attachment to the lifting frame 20, i.e., about the davit heads 64, in a counterclockwise direction from the perspective of FIG. 3. Continued tensioning of the rope 72 causes the dinghy 12 to continue its counterclockwise rotation in relation to the lifting frame 20, until the uppermost surfaces of the dinghy 12 eventually come into contact with the fifth and sixth side members 44*a*, 44*b* as depicted in FIG. 3.

At this point, the force being exerted by the tensioned rope 72 is transmitted to the lifting frame 20 by way of the dinghy 12 and the snap davits 62, which in turn causes the lifting frame 20 and the attached dinghy 12 to rotate in a counterclockwise direction from the perspective of FIG. 4. The rotation of the lifting frame 12 is facilitated by the pins that connect the first and second side members 40*a*, 40*b* to their corresponding mounting brackets 22. As can be seen in FIGS. 4 and 6, the lifting frame 20 is configured so that the first cross member 46*a*, the second cross member 46*b*, and the dinghy 12 remain clear of the outboard motor 16 as the lifting frame 20 rotates up and over the motor 16, toward its stowed position.

As the lifting frame 20 reaches the stowed position, the end portions of the first and second side members 40*a*, 40*b* each contact the top portion 30 of their corresponding mounting bracket 22, as can be seen in FIG. 4. The top portions 30 interfere with further rotation of the first and second side members 40*a*, 40*b*. The top portions 30 thus act as stops that prevent rotation of the lifting frame 20 past its stowed position, and limit the angular displacement of the lifting frame 20 to about 45 degrees.

The top portion 30 of each mounting bracket 22 is oriented at an angle of about 45 degrees in relation to the upper surface 23 of the swim platform 24; and the fifth and sixth side members 44*a*, 44*b* are angled by about 45 degrees in the opposite direction. As a result of this arrangement, the fifth and sixth side members 44*a*, 44*b* have substantially horizontal orientations, and are located at about the same height when the lifting frame 20 is in its stowed position. Because the fifth and sixth side members 44*a*, 44*b* act as supporting surfaces for the dinghy 12, the dinghy 12 assumes a substantially level, upside-down position on the fifth and sixth side members 44*a*, 44*b*, and over the outboard motor 16, when the lifting frame 20 is in its stowed position as shown in FIGS. 4 and 6.

Maintaining tension in the rope 72 maintains the lifting frame 70 in its stowed position, and secures the dinghy 12 in its upside-down position on top the lifting platform 20. If desired, additional provisions, such as bungees, cables, additional rope, etc., can be used to further secure the dinghy 12 and the lifting frame 20.

As can be seen in FIGS. 4 and 6, because the dinghy 12 is stowed over the outboard motor 16, in close proximity to the top of the outboard motor 16, the stowed dinghy 12 does not consume space within the cockpit or cabin of the boat 14; does not substantially interfere with the rearward view from the cockpit or cabin; and does not interfere with the use of the swim platform 24. Also, the lifting frame 20 positions the stowed dinghy 12 well above the waves; and provides a stable and secure platform for securing the dinghy 12 during operation of the boat 14 on the water, and during trailering of the boat 14.

The dinghy 12 can be deployed by unwinding the rope 72 from the winch 70. The combined weight of the dinghy 12 and the lifting frame 20 causes the lifting frame 20 to rotate clockwise from the perspective of FIG. 4, toward its lowered position, as the rope 72 is unwound. As the lifting platform 20 reaches its lowered position as shown in FIG. 3, contact between the first and second side members 40*a*, 40*b* and the upper surface 23 of the swim platform 24 prevents further clockwise rotation of the lifting frame 20. Once the lifting frame 20 has reached the lowered position, the user can untie the rope 72 from the rope attachment anchor 76. The user then can push the starboard side of the dinghy 12 outward, away from the boat 14. This action causes the dinghy 12 to rotate about the davit heads 74 and away from the lifting frame 20, under its own weight, until the dinghy 12 enters the water. The user and other passengers then can enter the dinghy 12 by stepping from the upper surface 23 of a swim platform 24, onto the platform 56 of the step 52, and into the dinghy 12. Once in the dinghy 12, the user can unclip the hooks 66 of the snap davits 62 from their corresponding davit heads 64, to uncouple the dinghy 12 from the lifting frame 20 and the boat 14.

The dinghy 12 thus can be lifted out of the water, stowed, and deployed back into the water without any need to remove, disassemble, or move the outboard motor 16, and without any need to modify the boat 14. When the dinghy 12 is stowed on top of the lifting frame 20, the dinghy 12 does substantially obstruct outside visibility from within the boat 14, and does not reduce the available passenger space within the boat 14. Also, the system 10 allows passengers to enter and disembark from the dinghy 12 in a safe and convenient manner, using the swim platform 24 of the boat 14.

In addition, because the lifting frame 20 also acts as the storage location for the dinghy 12, the lifting frame moves the dinghy 12 directly into its stowed position on the boat 14. Thus, the dinghy 12 does not have to be moved around the boat 14 once it has been hoisted, thereby eliminating the inconvenience and potential hazards associated with moving the relatively large and heavy dinghy 12 around within the confines of the boat 14. Also, the dinghy 12 can be deployed directly from its stowed location and into the water, making it possible to quickly deploy the dinghy 12 in time critical situations such as rescue operations or evacuation of the boat 14 under emergency conditions.

We claim:

1. A system for lifting and stowing a first water-borne vessel on a second water-borne vessel, the second water-borne vessel having an outboard motor mounted on a stern of the second water-borne vessel, the system comprising:

a first and a second mounting bracket configured to be secured to a mounting surface on the second water-borne vessel; and a lifting frame coupled to and configured to rotate in relation to the first and second mounting brackets between a first and a second angular position, the lifting frame comprising a first side, a second side, a first cross member connected to the first and second sides, and a second cross member connected to the first and second sides; wherein:

the first side has a substantially triangular configuration and comprises a first side member coupled to and rotatable in relation to first mounting bracket; a third side member connected to the first side member; and a fifth side member connected to the first and third side members and configured to provide a supporting surface for the water-borne vessel; and the second side has a substantially triangular configuration comprises a second side member coupled to and rotatable in relation to the second mounting bracket; a fourth side member connected to the second side member and a sixth side member connected to the second and fourth side members and configured to provide another supporting for the water-borne vessel;

the first and second cross members are connected to the first and second sides of the lifting frame;

the lifting frame is configured so that, when the lifting frame is in the first angular position, the first and second sides of the lining frame are located on opposite sides of the outboard motor and the second cross-member is positioned behind the outboard motor and is configured to be connected to the first water-borne vessel; and the lifting frame is further configured so that, when the lifting frame is in the second angular position, the second cross-member is positioned above the outboard motor, the fifth and sixth side members have a substantially horizontal orientation, and the lifting frame supports the first water-borne vessel above the outboard motor.

2. The system of claim 1, wherein the second cross member is configured to be connected to a first side of the first water-borne vessel so that the first water-borne vessel can rotate about the second cross member and onto the lifting frame.

3. The system of claim 2, further comprising a winch configured to be mounted on the second water-borne vessel and connected to a second side of the first water-borne vessel by a rope or a cable configured to exert a force on the second side of the first water-borne vessel when the rope or cable is tensioned by the winch.

4. The system of claim 3, wherein the force causes the first water-borne vessel to rotate onto the lifting platform when the lifting platform is in the second position of the lifting platform.

5. The system of claim 4, wherein the force further causes the lifting frame to rotate from the first to the second angular position after the first water-borne vessel rotates onto the lifting platform.

6. The system of claim 1, wherein the first and second mounting brackets are configured to restrain the respective first and second side members from rotating in a direction away from the first angular position when the lifting frame is in the second angular position.

* * * * *